US006662855B1

(12) United States Patent
Kaneto et al.

(10) Patent No.: US 6,662,855 B1
(45) Date of Patent: Dec. 16, 2003

(54) MOLDING DEVICE AND MOLDING METHOD OR SAND MOLD

(75) Inventors: Kimikazu Kaneto, Toyokawa (JP); Minoru Hirata, Toyokawa (JP); Yutaka Hadano, Toyokawa (JP)

(73) Assignee: Sintokogio, Ltd., Aichi-ken (JP)

( * ) Notice: Subject to any disclaimer, the term of this patent is extended or adjusted under 35 U.S.C. 154(b) by 123 days.

(21) Appl. No.: 09/869,265

(22) PCT Filed: Nov. 2, 2000

(86) PCT No.: PCT/JP00/07749

§ 371 (c)(1),
(2), (4) Date: Aug. 21, 2001

(87) PCT Pub. No.: WO01/32333

PCT Pub. Date: May 10, 2001

(30) Foreign Application Priority Data

| | | |
|---|---|---|
| Nov. 4, 1999 | (JP) | 11/313823 |
| Apr. 20, 2000 | (JP) | 2000/119857 |
| Jun. 19, 2000 | (JP) | 2000/183350 |

(51) Int. Cl.[7] ..... B22C 15/22

(52) U.S. Cl. ..... 164/200; 164/201; 164/207; 164/295; 164/37; 164/38

(58) Field of Search ..... 164/200, 201, 164/207, 195, 37, 38

(56) References Cited

U.S. PATENT DOCUMENTS 5,794,681 A * 8/1998 Oda et al. ..... 194/195

FOREIGN PATENT DOCUMENTS

| | | | |
|---|---|---|---|
| JP | 60-158949 | * | 8/1985 |
| JP | 3-56140 | * | 8/1991 |

* cited by examiner

*Primary Examiner*—M. Alexandra Elve
*Assistant Examiner*—I.-H. Lin
(74) *Attorney, Agent, or Firm*—Finnegan, Henderson, Farabow, Garrett & Dunner LLP

(57) ABSTRACT

A sand hopper (28) is provided at its lower position (40) with a plurality of nozzles (42) and a plurality of squeeze feet (46), the pressure of which is controlled, and which are located adjacent to a side of each squeeze foot. The sand hopper (28) is supported by supporting means (22, 26) such that it can move vertically. A mold space is defined by a pattern plate having a pattern (74*a*), a flask (4), a filling frame (52), and a sand hopper (28) having a plurality of squeeze feet (46) disposed above the filling frame (52). By discharging molding sand from the nozzles (42), it is introduced into the mold space. The mold sand (S2) in the mold space is compacted by the squeeze feet by lowering the sand hopper toward the mold space. Since the molding machine is so arranged, both introducing molding sand into a mold space and compacting the introduced molding sand are performed at one station (a molding-sand introducing and compacting station).

17 Claims, 21 Drawing Sheets

MOLDING DEVICE AND MOLDING METHOD OR SAND MOLD

FIELD OF THE INVENTION

This invention relates to an apparatus and a method for producing a sand mold, in particular, to an apparatus and a method for producing a sand mold wherein both introducing molding sand into a mold space and compacting the introduced molding sand are performed at one station.

DESCRIPTION OF THE PRIOR ART

In a conventional method of producing a sand mold by a mold-producing installation wherein both molding and teeming are performed while a sand mold is being held in a flask, it is known that introducing molding sand into a flask and compacting the introduced molding sand are performed in two different stations, which are spaced apart from each other (for example, JP 3-35842, A). Since both introducing molding sand into a flask and compacting molding sand introduced into another flask are simultaneously performed at that installation, sand molds are produced at a high rate. However, the installation requires both a molding-sand introducing station and a molding-sand compacting station, and further, requires more time and energy to transfer flasks between the two stations. Further, a molding machine must be provided with transfer equipment. For these reasons, a problem is caused in that the molding machine is complicated and expensive.

In another conventional method of producing a sand mold, wherein both the introduction and compaction of molding sand is performed in a single station, a ram must be horizontally moved above a mold space to compact the molding sand that has been introduced into the mold space. This also requires installing transfer equipment. Thus the same problem is caused, in that the molding machine is complicated and expensive.

The purpose of the present invention is to resolve those problems and to provide an apparatus and a method for producing sand molds wherein the cycle of producing them is shortened, and energy consumption is reduced.

SUMMARY OF THE INVENTION

In one aspect of the apparatus of the present invention for producing a sand mold, a plurality of nozzles are mounted on a lower portion of a sand hopper that contains molding sand, and a plurality of squeeze feet, the pressure of which is controlled, are mounted on the lower portion of the sand hopper at locations adjacent to a side of each nozzle. The sand hopper is supported by supporting means in such a manner that it can move vertically. A pattern plate having a pattern, a flask, a filling frame, and the sand hopper having the squeeze feet that are disposed above the filling frame all define a mold space. The molding sand in the sand hopper is introduced into the mold space by discharging it from the nozzles of the sand hopper, and the molding sand in the mold space is compacted by the squeeze feet when the sand hopper is lowered to the mold space. In the molding machine so arranged, both introducing molding sand into the mold space and compacting the molding sand in the mold space are performed at one station (a molding-sand introducing and compacting station). Thus the purpose of the invention is achieved.

In an example of the aspect, the supporting means hold the flask so that it moves vertically.

In an example of the aspect, either the supporting means or the sand hopper holds the filling frame so that it moves vertically relative to the sand hopper.

In both examples the molding space is readily defined, and the filling frame can be positioned at the level of a pass line (a transfer passage for flasks) that passes through the molding-sand introducing and compacting station of the molding machine.

Other aspects and advantages of the present invention will be understood when some preferred embodiments, which will be described below by reference to the accompanying drawings, are reviewed.

DESCRIPTION OF THE PREFERRED EMBODIMENTS

The outline of the molding machine of the present invention is explained relative to FIG. 1; the first embodiment of the molding machine is explained relative to FIGS. 2–9; the second embodiment of it is explained relative to FIGS. 10–16, and the third embodiment is explained relative to FIGS. 17–23. In the specification and these drawings the same reference numbers are used for the same or similar elements.

Figure 1A:
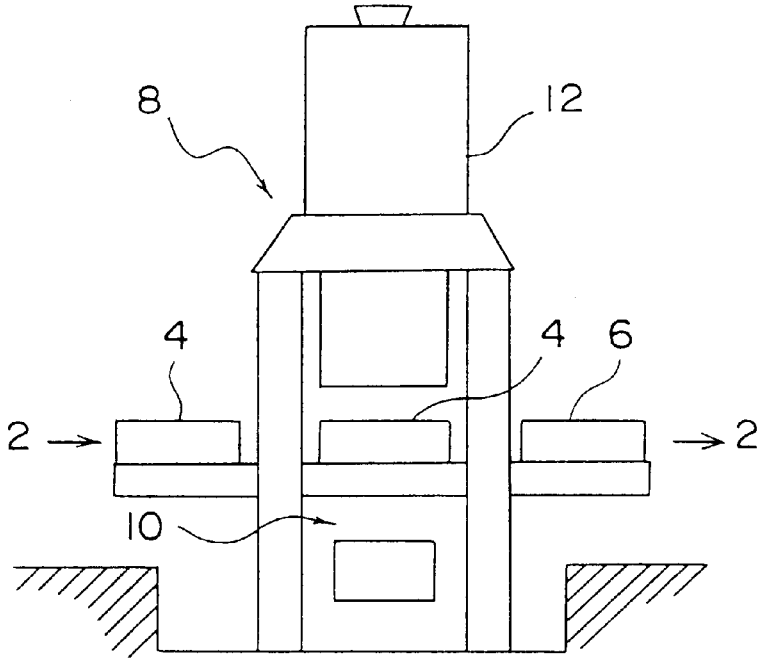
FIG. 1*a* is a schematic side view of a molding machine of an embodiment of the present invention, also showing a pass line along which flasks are transferred, and which relates to the molding machine.

In FIG. 1*a* a pass line 2 (a transfer passage for flask 4) is disposed so that it passes through a molding machine 8 (for producing a sand mold) of the present invention. Empty flasks 4 are transferred along the pass line 2 from the left, and each flask 4 is located at a molding-sand introducing and compacting station 10 of the molding machine 8. A sand mold 6 is produced in the flask 4 by a molding-sand introducing and compacting device 12 at the station 10, and the sand mold 6 held in the flask 4 is transferred to a teeming station (not shown) that is located on the pass line 2.

Figure 1B:
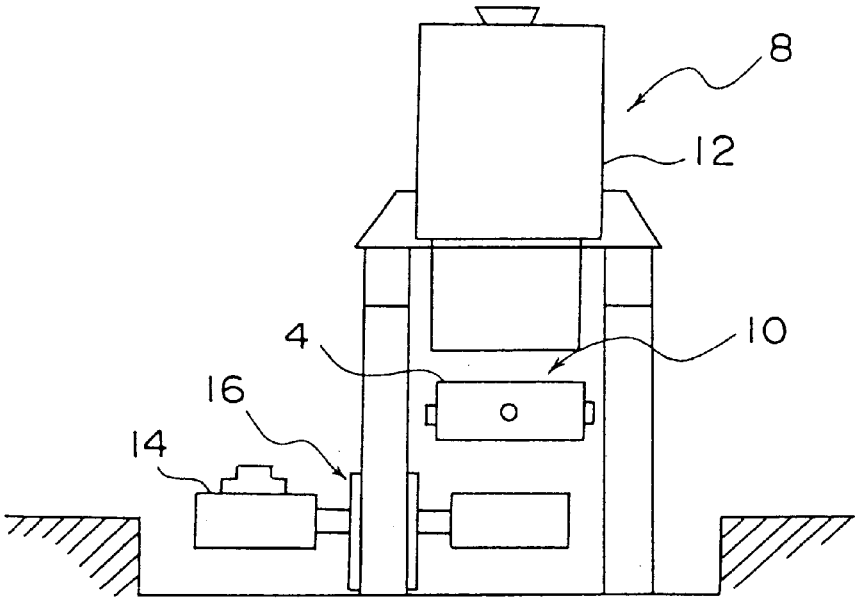
FIG. 1*b* is a schematic front view of the molding machine of FIG. 1*a*.

As shown in FIG. 1*b*, a pattern plate is carried by a carrier 14 and is transferred from the outside of the molding-sand introducing and compacting station 10 to the station 10 by a transfer device 16.

Figure 2:
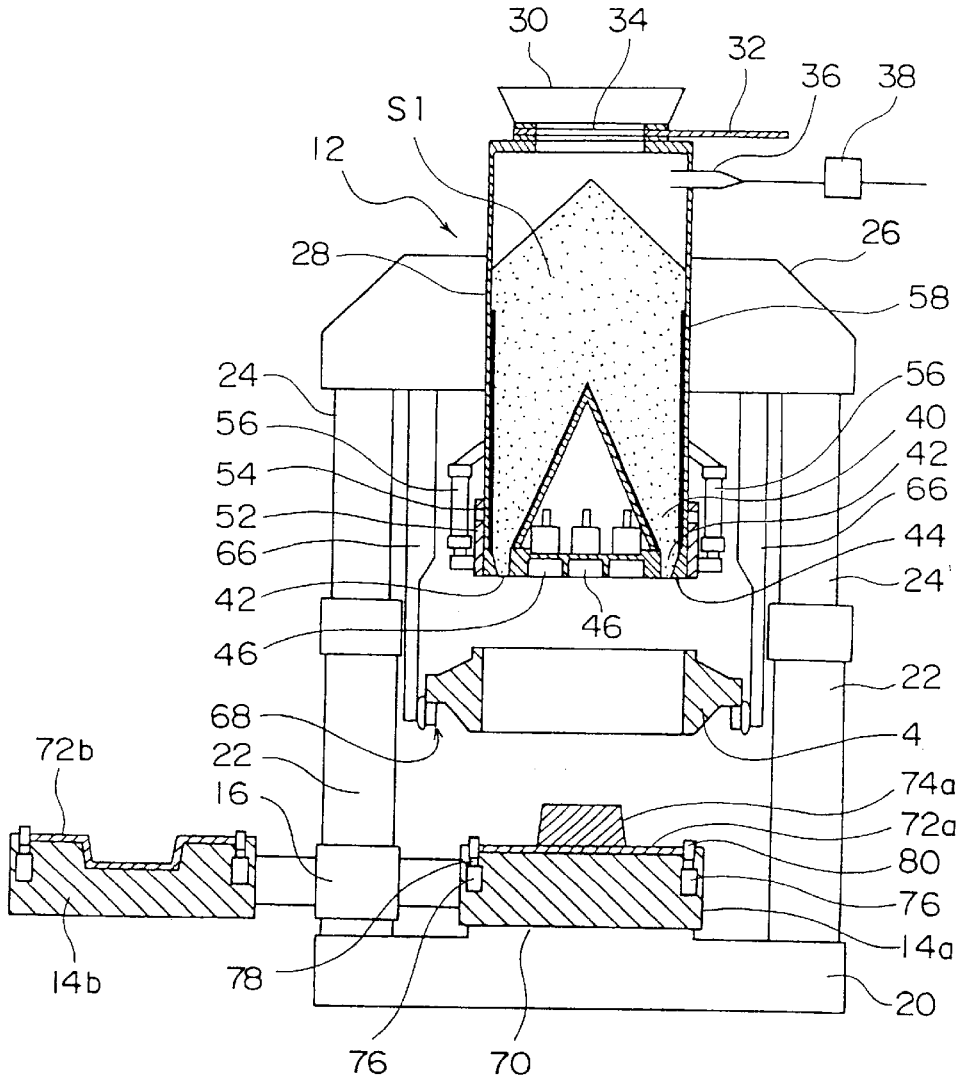
FIG. 2 is a front view of a molding machine of the first embodiment of the present invention.

A first embodiment of the molding machine is explained in detail relative to FIGS. 2–9. First, as in FIG. 2, a base 20 is fixedly mounted on a floor, and a plurality of upwardly facing cylinders 22 are mounted on the base 20. Although the number of the cylinders 22 may normally be two or four, two cylinders 22, 22 are used in the example shown in the drawing. A rigid mounting frame 26 is secured to the distal ends of the piston rods 24, 24 of the cylinders 22, 22. A sand hopper 28 is fixedly mounted on the central portion of the mounting frame 26. The cylinders 22, 22 and the mounting frame 26 act as supporting means for vertically carrying the sand hopper 28. A chute 30 having a slant wall for guiding sand is disposed on the top of the sand hopper 28, and a slide gate 32 is disposed under the chute 30 such that sand is introduced by a known device from above into the sand hopper 28 through the chute 30 and an opening 34 when the gate 32 is opened. FIG. 2 shows the sand hopper 28 being almost filled with molding sand S1. A pipe 36 for introducing compressed air into the sand hopper is connected to the upper part of the sand hopper 28 through its wall. The pipe 36 is connected to a valve 38 that is in turn connected to a source of compressed air (not shown).

Figure 3:
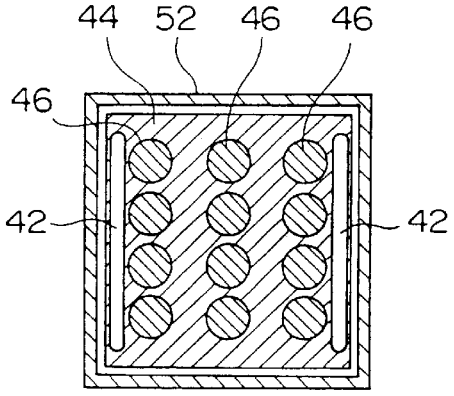
FIG. 3 is a bottom view of a sand hopper of the molding machine of FIG. 2.

As shown in FIGS. 2 and 3, the lower portion 40 of the sand hopper 28 diverges, and the diverging portions are tapered and have two nozzles 42, 42 at their lower ends. A cover member 44 fits on the nozzles 42, 42, and a plurality of (twelve in the example shown in the drawings) squeeze feet 46 are mounted on the cover member 44 at locations adjacent to one side of the nozzles 42.

Figure 4:
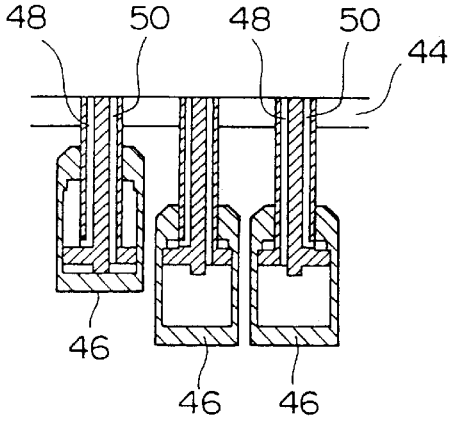
FIG. 4 is a schematic sectional view of the squeeze feet of the molding machine of FIG. 2.

FIG. 4 is a schematic sectional view of the squeeze feet 46. As is shown in this drawing, the leftmost squeeze foot 46 is in its upper position, and the two right squeeze feet 46 are in their lower positions. When air is introduced into a first air passage 48 of any one of the squeeze feet 46, while air is being discharged from its second air passage 50, that the squeeze foot 46 is raised to its upper position as the leftmost squeeze foot. In contrast, when air is introduced into the second air passage 50, while air is being discharged from the first air passage 48, the squeeze foot 46 is lowered to its lower position. Any one of the squeeze feet 46 may be located in an intermediate position between the upper and lower positions. If the pressure of the air in a squeeze foot is appropriately controlled, the position of the squeeze foot, in particular when a force is applied to it, can be controlled. Each squeeze foot acts as a ram, the pressure of which is controlled. The squeeze foot is a kind of an air (pneumatic) cylinder, and thus alternatively a ram that is mounted on an ordinarily used pneumatic cylinder may be used. Further, alternatively a hydraulic or electrical cylinder may be used if its pressure is controlled. Thus the squeeze foot includes the use of such cylinders in this invention.

FIG. 2 is now referred to again. The squeeze feet 46 all are at their upper positions in this drawing. When they are in the upper positions, their lower ends and the lower ends of the nozzles 42 are in the same horizontal plane. A filling frame 52 is disposed adjacent to the circumference of the external wall of the lower portion 40 of the sand hopper 28. A pair of cylinders 56, 56 that are attached to the external wall of the lower portion 40 of the sand hopper 38 carry the filling frame 52 such that it moves vertically relative to the supporting means 22, 26 and the sand hopper 28. A plurality of vent holes 54 are formed in the filing frame 52. These vent holes 54 are provided for controlling discharging air caused by aeration (this will be explained in detail below). The molding sand S1 in the diverging portions of the lower portion of the sand hopper 28 (portions upstream of and adjacent to the nozzles 42, 42) is fluidized by an aeration device 58.

Figure 5:
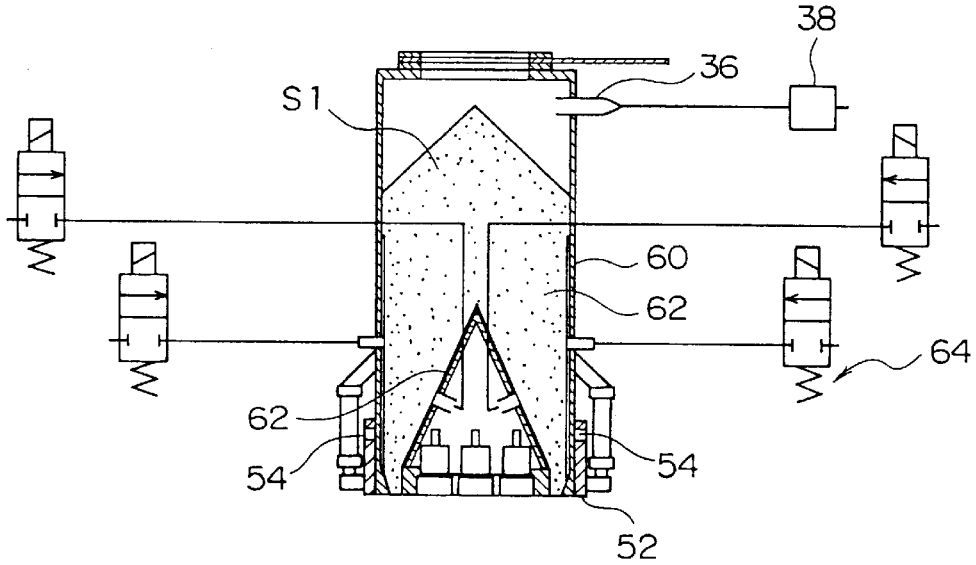
FIG. 5 is an explanatory drawing showing a sand hopper of the molding machine together with an aeration device.

As is shown in FIG. 5, plates 62 formed with many holes are disposed inside the walls of the diverging portions so that air chambers 60 are formed there. Compressed air is supplied by a compressed air supplying and blowing device 64 through the chambers 60 to the molding sand S1 in the sand hopper to fluidize it.

FIG. 2 is again referred to. A pair of upright members 66 are suspended from the mounting frame 26, and a roller device or conveyor 68 is disposed on the lower ends of the upright members 66. The conveyor 68 acts to transfer the flasks 4 along the pass line 4 shown in FIG. 1*a*. The flask 4 shown in FIG. 2 is located on the pass line 2.

A pattern plate carrier 14*a* is disposed under the hopper 28 and the flask 4 (i.e., it is disposed at the molding-sand introducing and compacting station 10 in FIG. 1). The carrier 14*a* is connected via the transfer device 16 to another pattern plate carrier 14*b* located outside the molding-sand introducing and compacting station 10. The transfer device 16 in the embodiment is a revolving mechanism that changes the locations of the pattern plate carriers 14*a*, 14*b* by rotating them. Alternatively, as a transfer device a reciprocating linear movement device that has a single pattern carrier plate and that linearly moves it between two places, one being at the molding-sand introducing and compacting station 10, the other being outside the station, may be used. A gap 70 of about 5mm is located between the bottom of the pattern carrier plate 14*a* and the base 20, and a plurality of springs, for example, plate springs (not shown), are disposed in the gap 70. The pattern plate carrier 14*a* is supported by the springs. The pattern plate carriers 14*a*, 14*b* may respectively carry different pattern plates (for example, a pattern plate 72*a* for a cope and a pattern plate 72*b* for a drag). A pattern 74*a* is fixed to the pattern plate 72*a* located on the carrier plate 14*a*. A plurality of vent holes (not shown) are formed in the pattern plate 72*a* and the pattern plate carrier 14*a*.

A plurality of cylinders 76 are embedded in the pattern plate carrier 14*a* (and 14*b*), and a leveling frame 80 that encloses a circumferential edge of the pattern plate 72*a* (72*b*) is attached to the piston rods 78 of the cylinders 76. The top of the leveling frame 80 in FIG. 2 is in its upper position and protrudes from the top surface of the circumferential edge of the pattern plate 74*a* (74*b*) at that position. The lower position of the top of the leveling frame 80 is at the same level as the top surface of the circumferential edge of the pattern plate 74*a* (74*b*) (see FIG. 8).

The operation of the molding machine arranged as explained above will be explained below.

Figure 6:
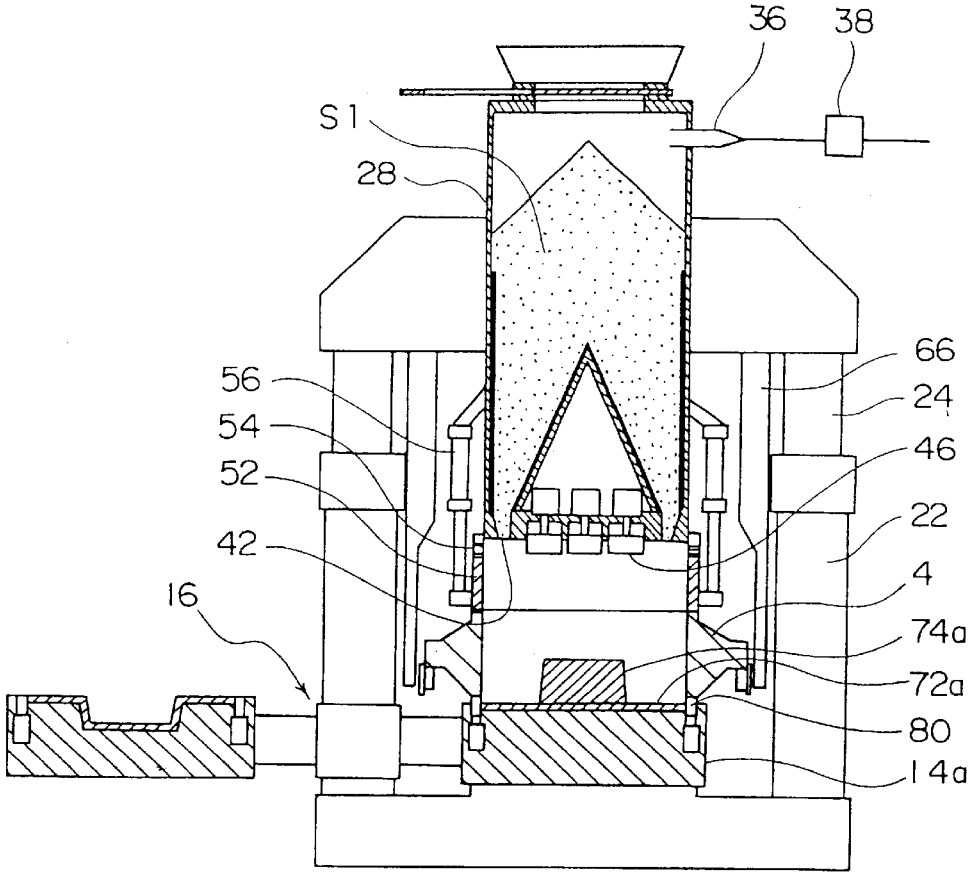
FIG. 6 shows the molding machine of FIG. 2 where a mold space has just been defined.

From the state shown in FIG. 2 the supporting cylinders 22, 22 and the cylinders 56, 56 of the filling frame are actuated to lower the flask 4, the sand hopper 28, and the filling frame 52 so that the flask 4 is placed on the leveling frame 80 and so that the filling frame 52 is placed on the flask 4. At that time the pattern plate carrier 14*a* is pushed toward the base 20 against the resilient force of the springs. The squeeze feet 46 are then lowered to their lower positions so that they protrude into the filling frame 52. This state is shown in FIG. 6. Under that state a mold space (a space into which molding sand is introduced) is defined by the pattern plate 72*a* having the pattern 74*a*, the flask 4, the filling frame 52, and the sand hopper 28 that includes the squeeze feet 46 (the molding-sand introducing and compacting device 12 in FIG. 1). The pattern 74*a* protrudes upward at the center of the lower part of the mold space, and correspondingly the squeeze feet 46 protrude downward at the center of the upper part of the mold space.

Figure 7:
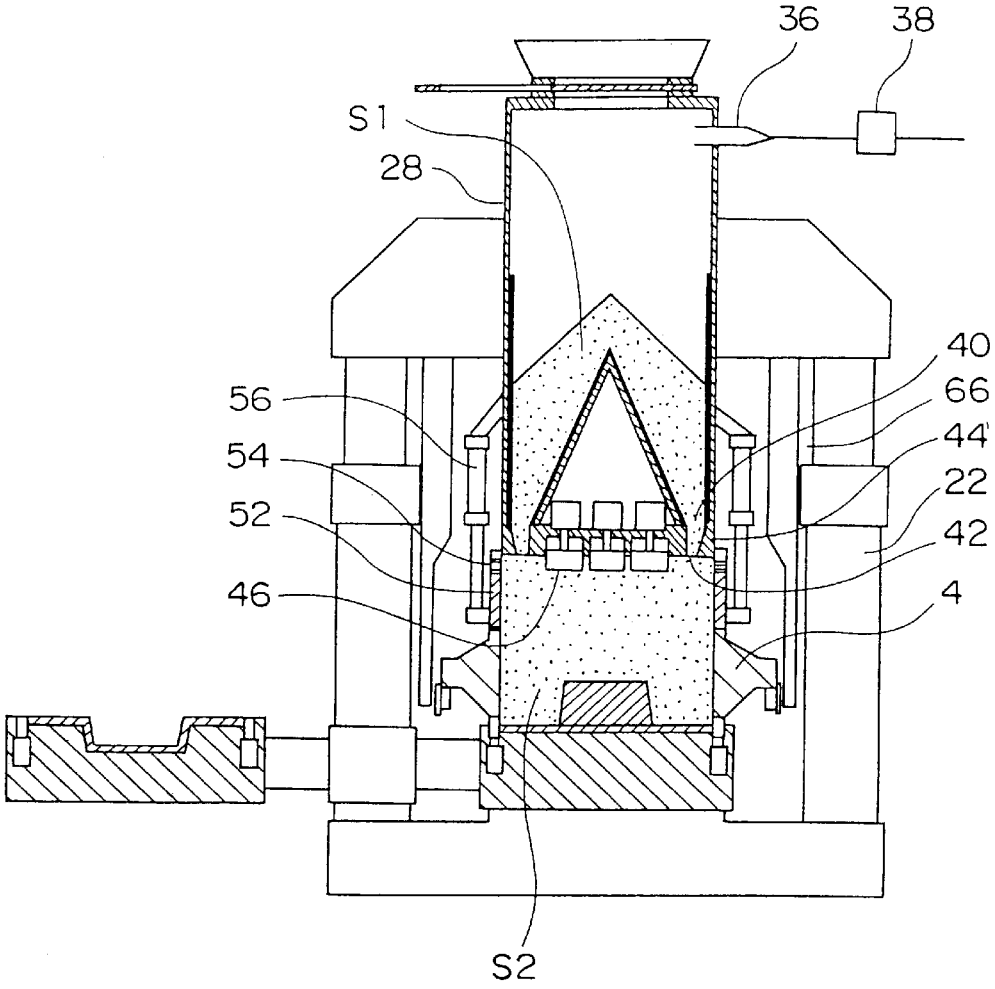
FIG. 7 shows the mold space of FIG. 6 into which molding sand has been introduced.
Figure 8:
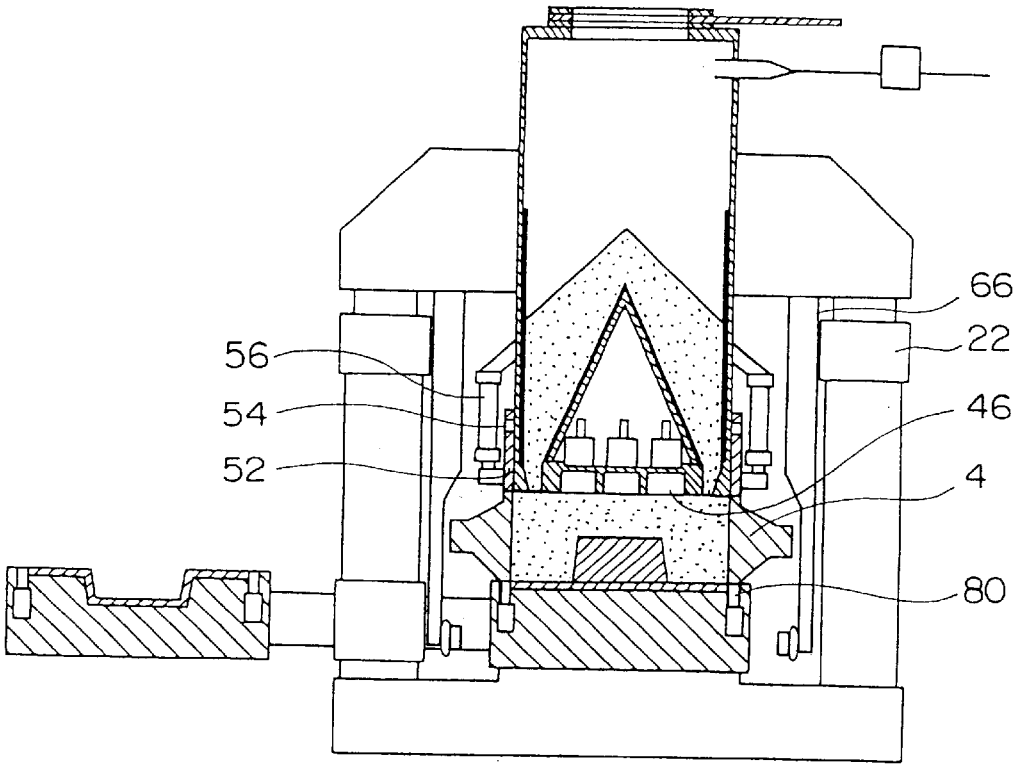
FIG. 8 shows the molding sand in the mold space of FIG. 7 that has just been compacted.

The aeration device 58 of FIG. 2 is then operated to fluidize the molding sand S1 held in the lower portion 40 of the sand hopper 28 at the locations upstream of and adjacent to the nozzles 42, 42, and the valve 38 is opened to introduce compressed air into the sand hopper 28 through the pipe 36, so that the molding sand is discharged from the nozzles and introduced into the mold space, as shown in FIG. 7. Since the aeration device 58 is used to fluidize the molding sand S1 in the lower portion 40 of the sand hopper 28, the pressure of the compressed air that is introduced into the sand hopper through the pipe 36 can be low (for example, 0.05–0.18 MPa, preferably 0.05–0.10 MPa). As is performed in this embodiment, introducing molding sand into a mold space by supplying a compressed airflow under a low pressure to the surface of the molding sand S1, and by simultaneously fluidizing the molding sand S1 of the lower portion 40 of the sand hopper (this introduction of the molding sand is herein called "aeration introduction"), enables, in comparison with the blowing introduction of molding sand, the molding sand to be gently introduced, and in particular, to be introduced into a mold space having a complicated pattern (in particular, having a long pocket). The aeration introduction also reduces the amount of air to be used. By reason of these advantages, preferably the aeration introduction is used. However, alternatively, the molding sand S1 can be introduced by the conventional blowing introduction, according to the case. When the blowing introduction is used, the pressure of the air to be introduced from the compressed-air introducing pipe 36 is 0.2–0.5 MPa (it is unnecessary to fluidize the molding sand S1 in the lower portion 40 of the sand hopper by aeration). Further, alternatively it is possible to introduce the molding sand into the mold space by just aerating the molding sand S1 in the lower portion 40 of the sand hopper. Discharging the air that is introduced into the sand hopper 28 to introduce the molding sand into the mold space is performed by controlling the vent holes 54 formed in the filling frame 52 and the vent holes (not shown) formed in the pattern plate 72*a*.

From the state shown in FIG. 7 the cylinders 56, 56 of the filling frame are caused to be free to move, and the supporting cylinders 22, 22 are actuated under a pressure that is higher than the controlling pressure of the squeeze feet 46 to lower the sand hopper 38 and the squeeze feet 46. Further, the cylinders 76 for the leveling frame are set so that their actuating fluid is free to be discharged from them, and the sand hopper 28 and the squeeze feet 46 are further lowered until the squeeze feet 46 reach their upper positions. Thus the molding sand S2 in the mold space is compacted (as in FIG. 8). Since the leveling frame 80 is kept at its position during the squeezing operation up to the intermediate point in the squeezing operation and then released from that position, the sand mold is well compacted.

Figure 9:
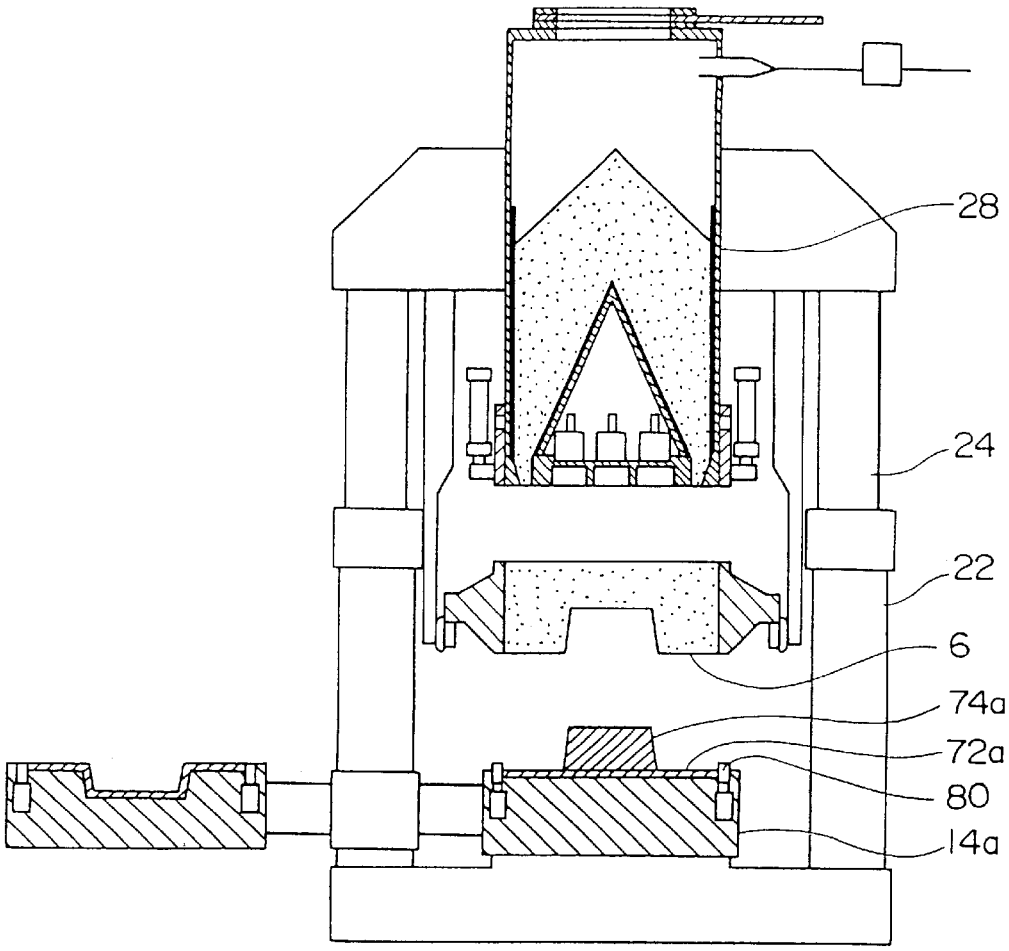
FIG. 9 shows a sand mold held in a flask that is moved from the state shown in FIG. 8, i.e., being separated from a pattern plate, and that is located on the pass line.

Removing the sand mold 6 with the flask (FIG. 9) is now explained. From the state shown in FIG. 8 the cylinders 56, 56 of the filling frame are retracted, and the cylinders 76 are actuated to raise the leveling frame 80 and push it against the flask 4. The piston rods 24, 24 of the supporting cylinders 22, 22 are then extended to raise the sand hopper 28. Thus, as shown in FIG. 9, the filling frame 52 is raised relative to the sand hopper 28; the flask 4 holding the produced sand mold 6 therein is raised to the level of the pass line 2, shown in FIG. 1*a*, by the roller device (conveyor) 68 mounted on the lower ends of the upright members 66; and the sand hopper 28 is raised to a position above the flask 4. The sand mold 6 having the flask 4 is then transferred along the pass line 3 to the teeming station. The sand mold 6 having the flask is raised a small distance from its stationary state when it is removed from the pattern plate. Since this raising is performed when the piston rods 24, 24 of the supporting cylinders 22, 22 are maximally retracted, accurate removing is achieved.

In relation to FIGS. 10–16, the second embodiment is now explained. A flask 4 (FIG. 10) is on the pass line 2 of FIG. 1*a* and is located at the molding-sand introducing and compacting station 10. In the second embodiment, a base 20, pattern plate carriers 14*a*, 14*b*, cylinders 76 embedded in the pattern plate carriers 14*a*, 14*b*, leveling frames 80 attached to the piston rods 78 of the cylinders 76, a gap 70 disposed between the base 20 and each pattern plate carrier, springs disposed in the gap, a transfer device 16, a slide gate 32, a sand-introducing opening 32, a compressed-air introducing pipe 36 of a sand hopper 28, a filling frame 52, vent holes 54 of the filling frame, cylinders 56, 56 of the filling frame attached to the sand hopper 28, a flask 4, a conveyor 68 that carries the flask, and a pair of upright members 66, 66 for supporting the conveyor are the same as those in the first embodiment. Thus the same reference numbers are used for these elements, and they will not be further described.

Figure 10:
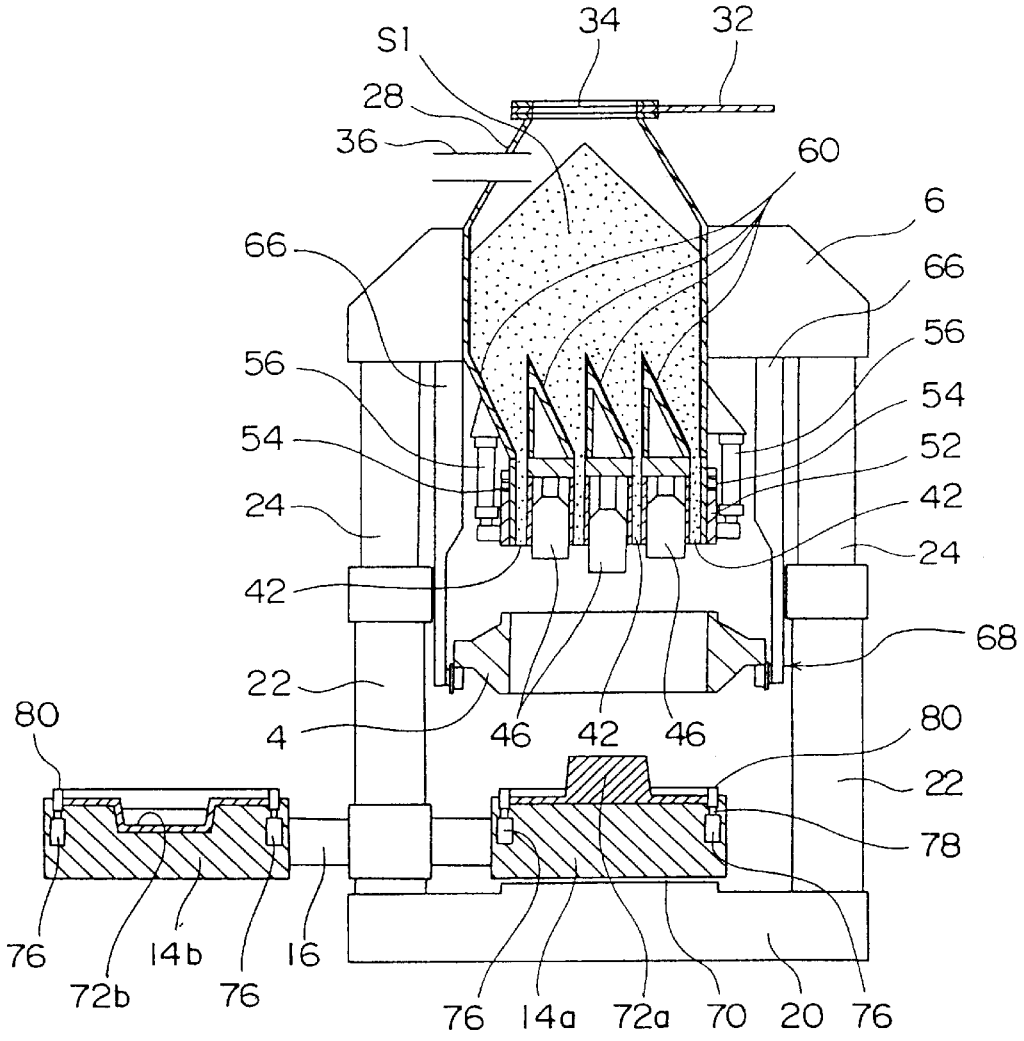
FIG. 10 is a front view of the molding machine of the second embodiment of the present invention.

In FIG. 10, four upwardly facing cylinders 22 are mounted on the base 20, and a rigid mounting frame 26 is secured to the distal ends of the piston rods 24 of the cylinders 22. A sand hopper 28 is secured to a substantially central part of the mounting frame 26. The lower portion of the sand hopper 28 is divided into a plurality of (four in the example shown in the drawing) sand passages, and four nozzles 42 are formed at their distal ends. A plurality of squeeze feet 46 are arranged in a grid array adjacent to a side or sides of the nozzles 42. The structure of each squeeze foot 46 is the same as that of the squeeze foot shown in FIG. 4 relative to the first embodiment. When the squeeze foot 46 is in its upper position, its bottom is at the level of the bottom of each nozzle 42. In FIG. 10 the central squeeze foot 46 is in its lower position, and the right and left squeeze feet 46 are in a position between the upper position and the lower position. As in the first embodiment, air chambers 60 for aeration are provided inside the peripheral walls of the four divided portions of the lower portion of the sand hopper 28. Compressed air is supplied to the chambers 60 by using a device like the compressed-air supplying and blowing device shown in FIG. 5. Thus the compressed air jet is supplied from the chambers 60 to the molding sand S1 adjacent to and upstream of the nozzles 42 to fluidize it there.

Figure 11:
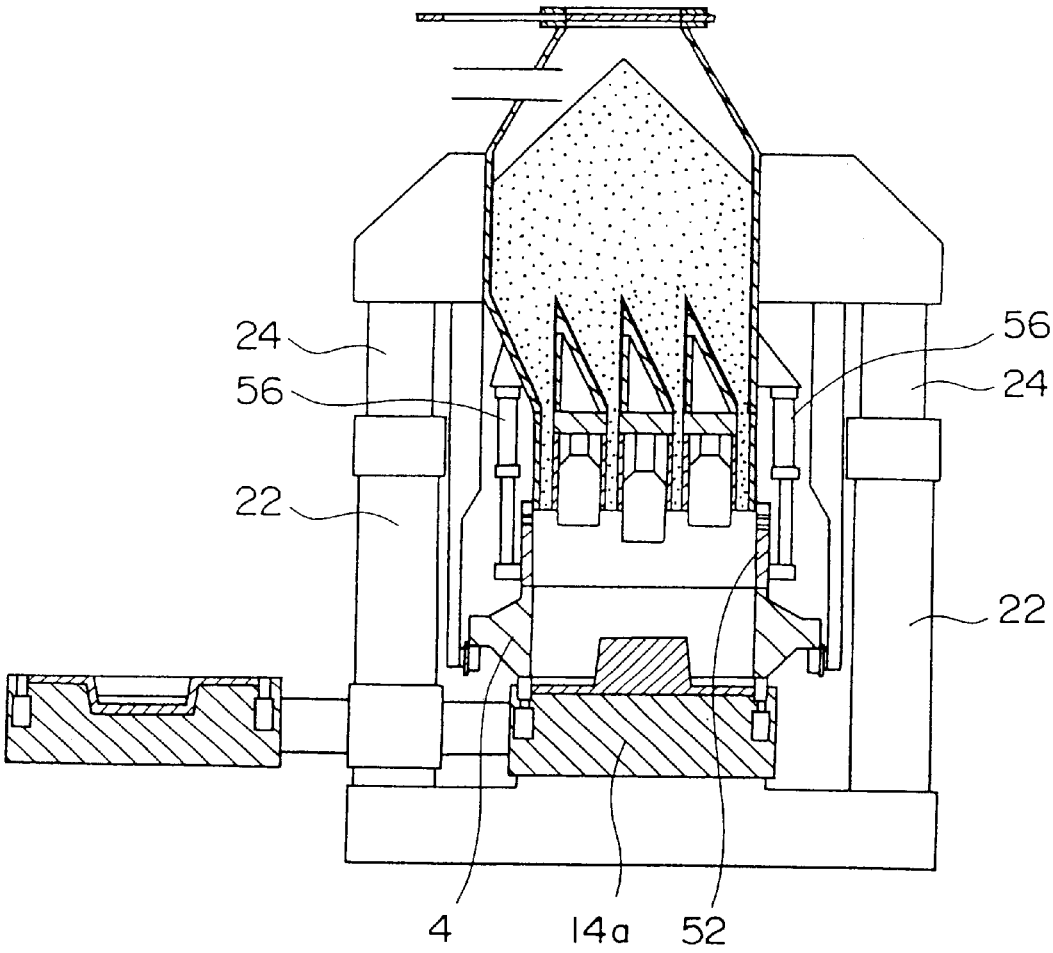
FIG. 11 shows the molding machine of FIG. 10 where a mold space has just been defined.
Figure 12:
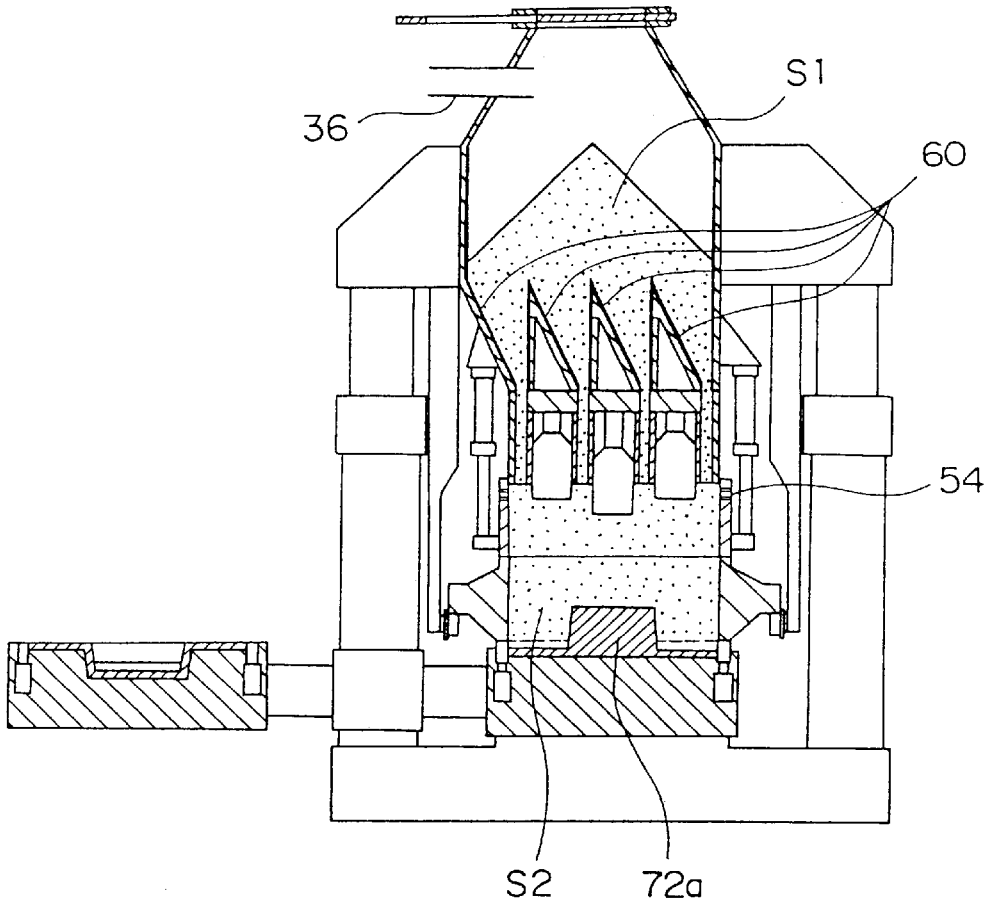
FIG. 12 shows the mold space of FIG. 11 into which molding sand has been introduced.
Figure 13:
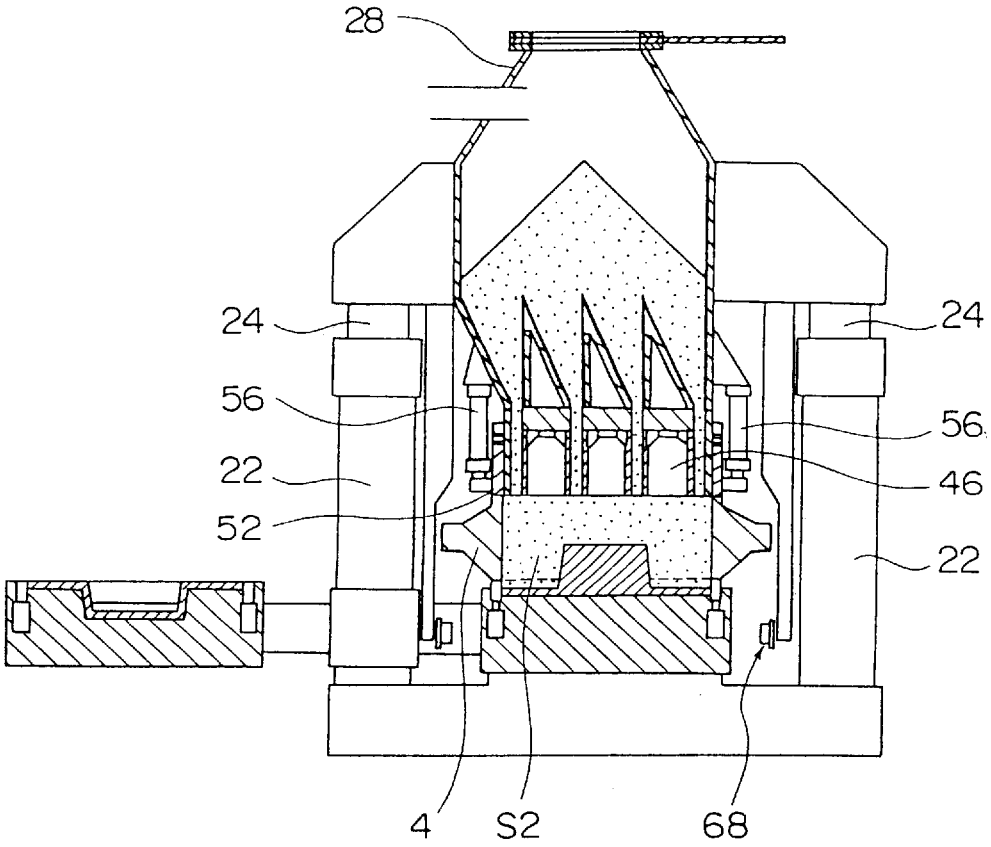
FIG. 13 shows the state of the molding sand in the mold space of FIG. 12 being primarily compacted.

The operation of the molding machine of FIG. 10 is now explained. From the state shown in FIG. 10 the piston rods 24 of the supporting cylinders 22 are retracted to lower the sand hopper 28 and the flask 4, while the cylinders 56, 56 of the filling frame 52 are being actuated to lower the filling frame 52 relative to the sand hopper 28, as shown in FIG. 11. In FIG. 11 the leveling frame, the pattern plate, the flask, the filling frame, and the sand hopper that includes the squeeze feet define a mold space. The squeeze feet 46 protrude into the mold space. As is used in the first embodiment, by using the aeration introduction where the aeration device is operated to fluidize the molding sand in the lower portion of the sand hopper 28, while compressed air of a low pressure is being introduced through the air introducing pipe 36, the molding sand S1 in the sand hopper 28 is introduced into the mold space. FIG. 12 shows the molding sand S2 introduced into the mold space. As in FIG. 13, the cylinders 56 of the filling frame are retracted, while the piston rods 24 of the supporting cylinders 22 are being further retracted to compact the molding sand S2 in the mold space (the primary squeeze). In this primary squeeze the squeeze feet 46 are retracted to their upper position, and the height of the molding sand S2 substantially equals the total height of the leveling frame 80 and the flask 4. Further, the slide gate 32 is opened to the right, and the opening 32 is exposed. Further, in the primary squeeze the operation of retracting the supporting cylinders 22 is continued until the pressure of the primary squeeze, which is measured by a sensor (not shown), reaches its nominal pressure, or until the encode position of the piston rods of the cylinders 22 reaches the nominal value of the primary squeeze.

Figure 14:
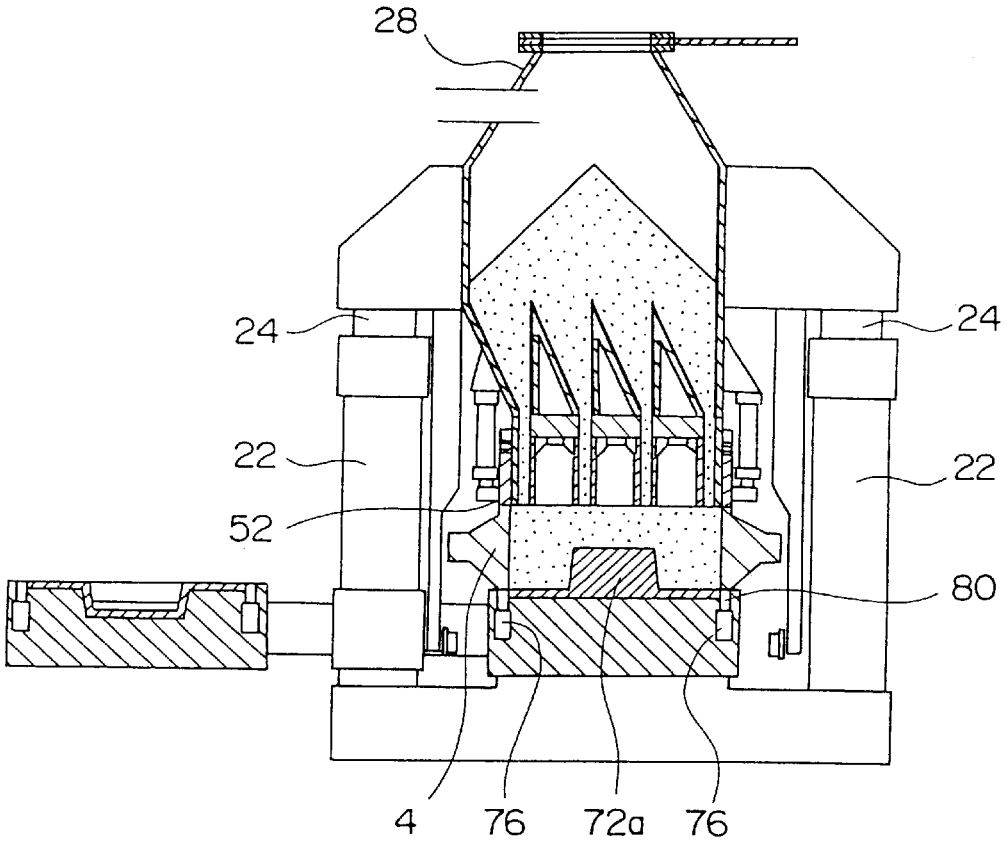
FIG. 14 shows the sand mold being further, or secondarily, compacted from the state as in FIG. 13.

The cylinders 76 of the leveling frame 80 are then set so that the actuating oil in them is free to be discharged therefrom, while the supporting cylinders 22 are being retracted under a pressure higher than that of the primary squeeze to lower the squeeze feet 46, the filling frame 52, and the flask 4 to further compact the molding sand S2 (the secondary compaction). Thus the leveling frame 80 is lowered to its lower position, which is at the level of the upper surface of the circumferential edge of the pattern plate 72*a*, as shown in FIG. 14. If the pressure of the secondary squeeze does not reach the nominal pressure even when the leveling frame 80 reaches its lower position, a further squeeze is performed by retracting the cylinders 56, 56 of the filling frame and by further retracting the supporting cylinders 22.

When the pressure of the secondary squeeze reaches the nominal pressure of the secondary squeeze, a timer (not shown) starts, and squeezing under the nominal pressure of the secondary squeeze is maintained for a predetermined period of time. Due to the squeezing being maintained for a predetermined period of time, the air contained in the molding sand S2 in the flask (a sand mold) can be squeezed out. If the leveling frame 80 does not reach its lower position at that time, the cylinders 56, 56 of the filling frame are extended to lower the filling frame 52 until the leveling frame 80 reaches its lower position. By doing so, the bottom of the flask 4 is at the same level as the bottom of the sand mold.

Figure 15:
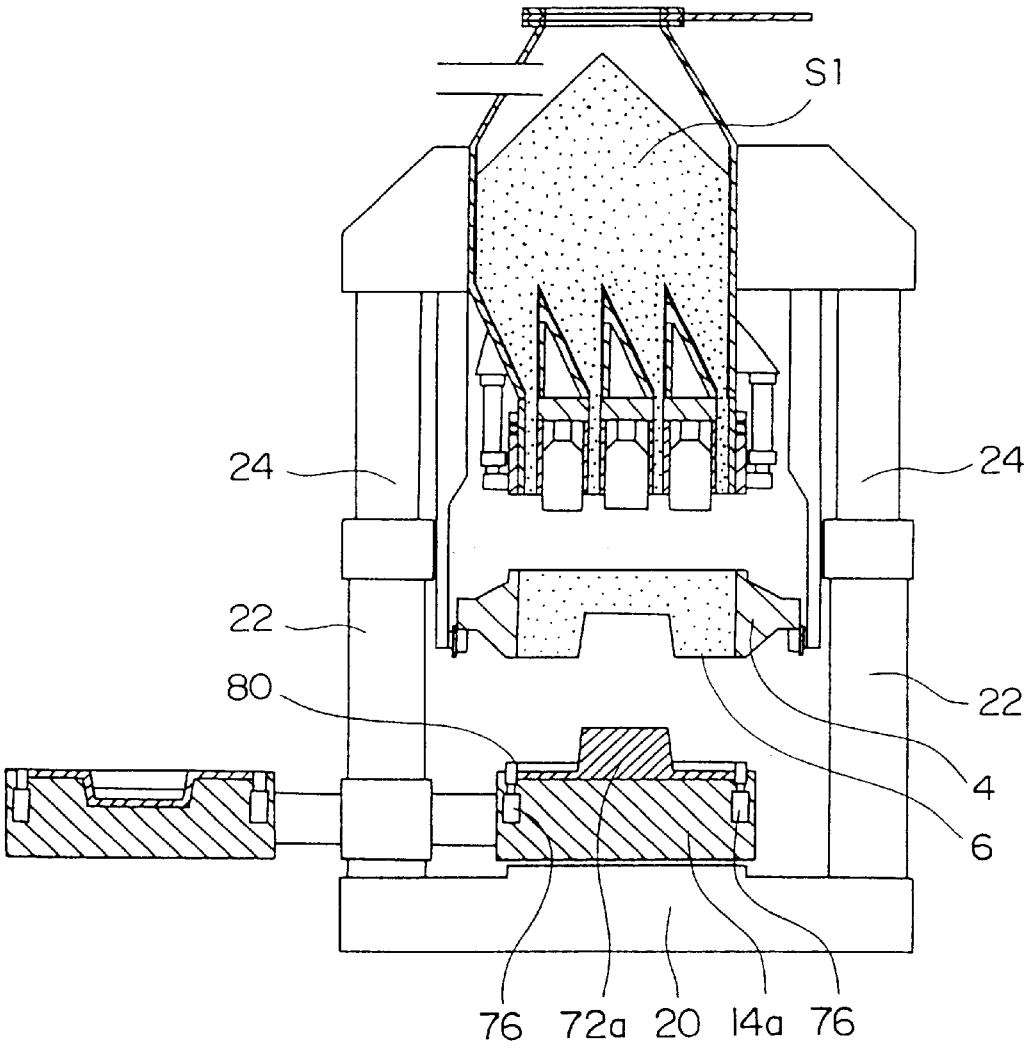
FIG. 15 shows the molding machine shown in FIG. 14 wherein a sand mold held in a flask has been separated from a pattern plate and located on the pass line.

As in FIG. 15, the cylinders 76 are then actuated to raise the leveling frame 80, and the piston rods 24 of the supporting cylinders 22 are extended. Thus the sand hopper 28, the filling frame 52, the squeeze feet 46, and the pair of upright members 66 are together raised to their original positions, and the flask 4 holding the sand mold 6 is picked up by the conveyor 68 attached to the pair of the upright members 66 and is located on the pass line. Molding sand S1 is introduced into the sand hopper 28.

Figure 16:
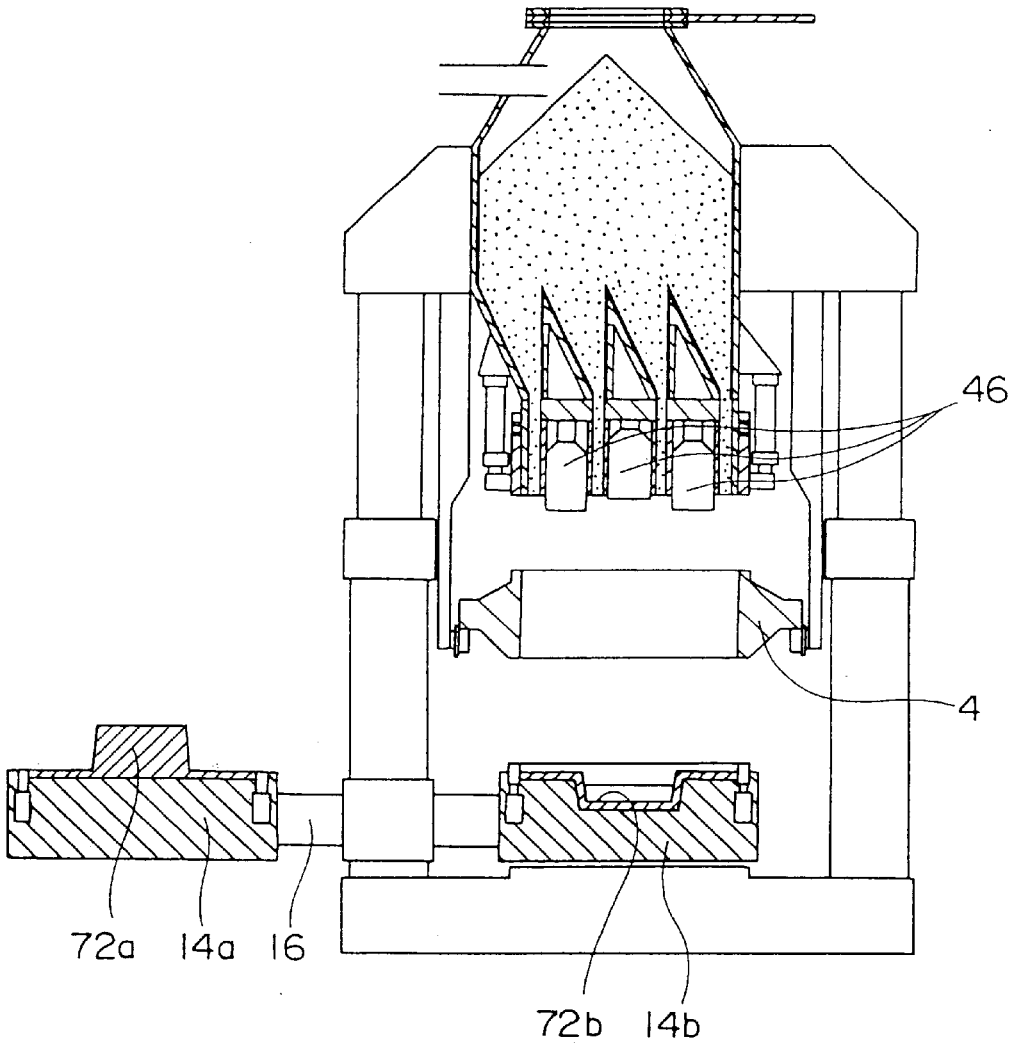
FIG. 16 shows the molding machine of FIG. 15 wherein a new, empty flask has been transferred into the molding-sand introducing and compacting station of the molding machine, and a new pattern plate has been disposed at the station by a transfer device.

As in FIG. 16, a new, empty flask is transferred along the pass line to the molding-sand introducing and compacting station, and the transfer device 16 is rotated to change the pattern plates 72*a*, 72*b* so that the pattern plate 72*b* is positioned at the station. Further, the outside squeeze feet 46 are lowered to their lower position so that the central squeeze feet 46 are concave relative to the outside ones. This concave shape corresponds to the opposite, concave pattern plate 72*b*.

The same molding process is repeated.

Figure 17:
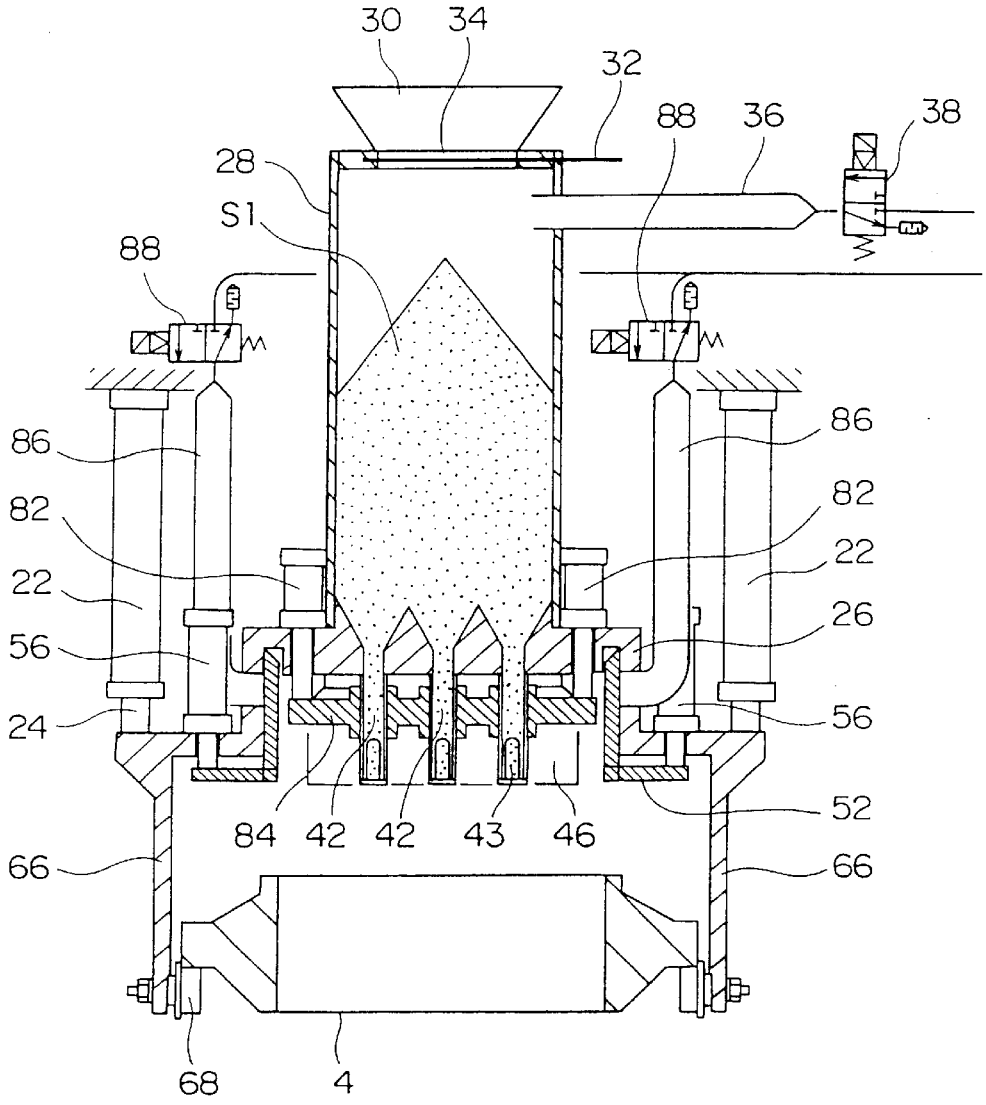
FIG. 17 is a front view of the molding machine of the third embodiment of the present invention.
Figure 17:
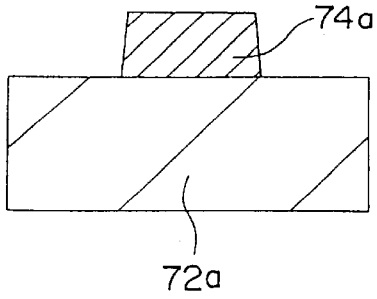

By means of FIGS. 17–23 the third embodiment of the molding machine will be explained. The flask 4 shown in FIG. 17 is located at the molding-sand introducing and compacting station of the molding machine and located on the pass line 2 of FIG. 1*a*. The molding machine in FIG. 17 has four downwardly facing supporting cylinders 22 that are fixed to a predetermined place (for example, a ceiling frame). A rigid mounting frame 26 is secured at its four corners to the distal ends of the piston rods 24 of the supporting cylinders 22. A pair of upright members 66 are suspended from the sides of the mounting frame 24 (the sides where the supporting cylinders 22 are located in FIG. 17). A roller device (conveyor) 68 that transfers the flask 4 along the pass line is mounted on the lower ends of the upright members 66.

A sand hopper 28 is secured to the central portion of the mounting frame 26. The sand hopper 28 is supported by the supporting means (the supporting cylinders 22 and the mounting frame 26) so that it moves vertically. Molding sand S1 has been introduced into the sand hopper 28 through a chute 30 and an opening 34, which is exposed when a slide gate 32 is opened. The lower end of the sand hopper 28 is divided into several portions (nine portions in the example shown in the drawing), each of which is shaped as a funnel, and these portions penetrate the mounting frame 26 and form nozzles 42 at their distal ends. When a valve 38, which is connected to a source of compressed air (not shown), is opened to introduce compressed air into the hopper through the pipe 36, the molding sand S1 is discharged downwardly from openings 43 formed in the distal ends of the nozzles 42.

Figure 18:
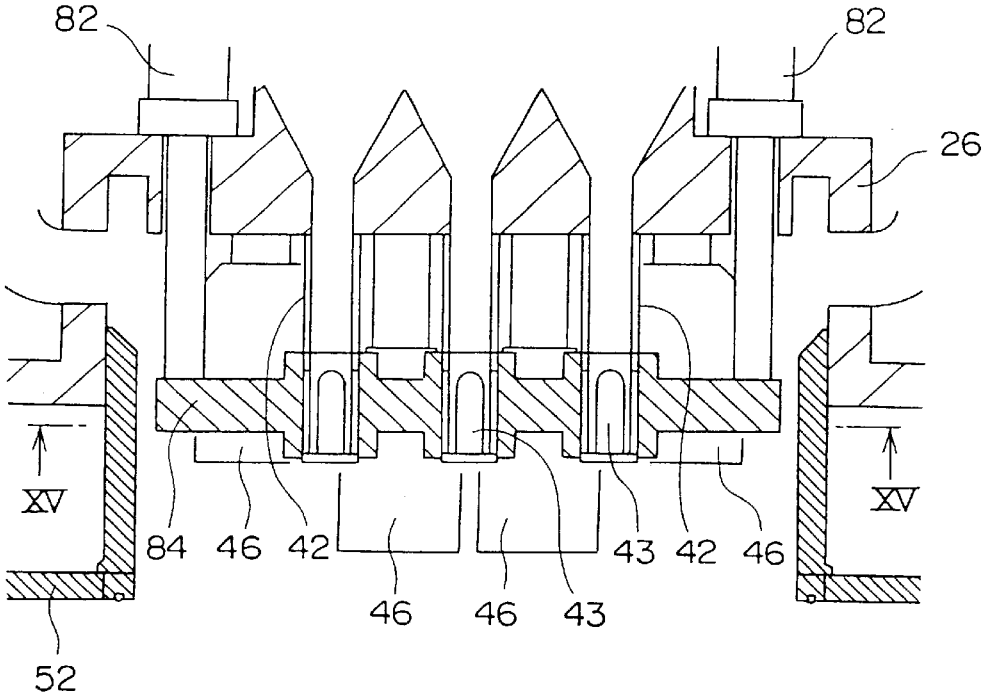
FIG. 18 is a sectional view showing some nozzles and squeeze feet of a sand hopper of the molding machine of FIG. 17.
Figure 19:
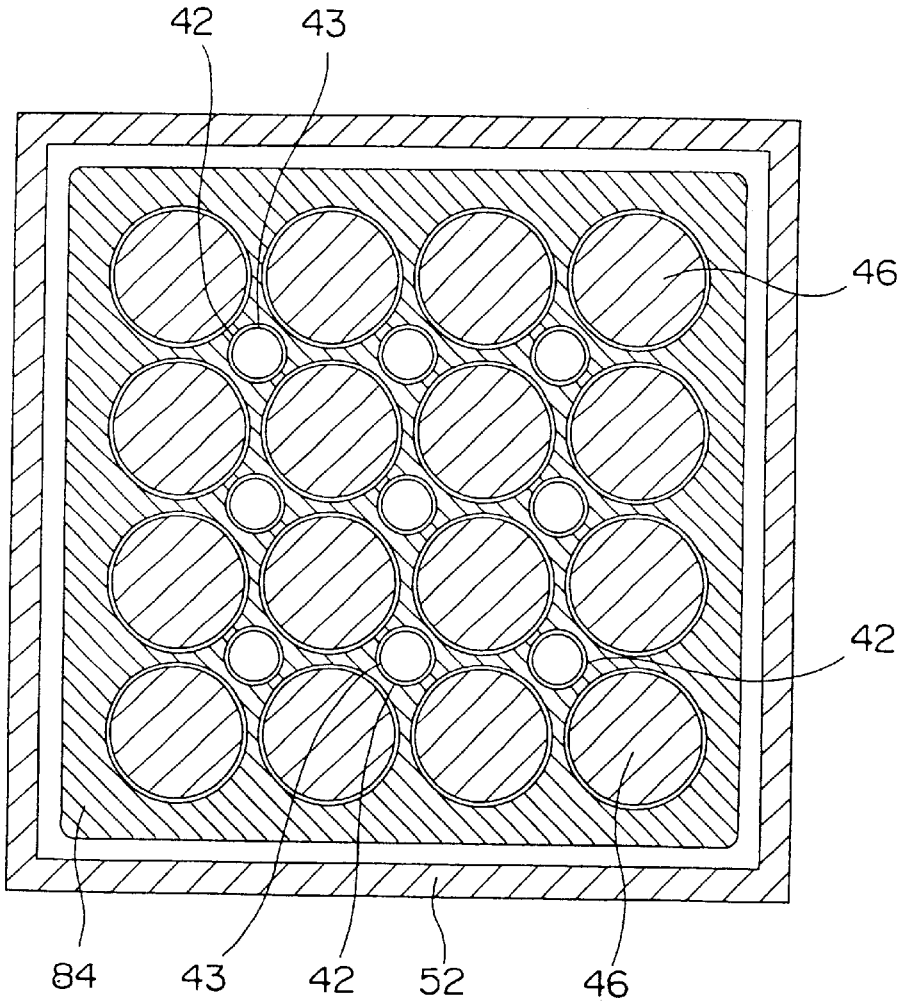
FIG. 19 is a cross-sectional bottom view along line XV—XV showing an array of the nozzles and the squeeze feet.

In FIGS. 17–19 an array of squeeze feet 46 (sixteen squeeze feet in the example shown in the drawings) are disposed adjacent to the sides of the nozzles. These squeeze feet are mounted on the mounting frame 26 and have the same structure and do the same work as those used in the first embodiment. A pair of downwardly facing cylinders 82, 82 are mounted on the mounting frame 26 at the sides of the sand hopper 28, and a bottom cover 84 is secured to the distal ends of the piston rods of the cylinders. The cover 84 is arranged to close the openings 43 of the nozzles 42 when the piston rods of the cylinders 82, 82 are fully extended.

In FIG. 17 another pair of downwardly facing cylinders 56, 56 for a filling frame are mounted on the mounting frame 26 inside the supporting cylinders 22, and a filling frame 52 is secured to the distal ends of the piston rods of the cylinders 56, 56. A groove is formed in the bottom of the mounting frame 26, and the upper end of the filling frame 52 enters the groove when the filing frame is in its upper position (i.e., when the piston rods of the cylinders 56, 56 of the filling frame are fully retracted). A plurality of air supply pipes 86 that penetrate the walls of the mounting frame 26 are disposed, and each air supply pipe 86 is connected to a source of compressed air (not shown) through a valve 88. As in the first embodiment, a pattern plate 72*a* having a pattern 74*a* is disposed under the sand hopper 28 and the flask 4.

The operation of the molding machine arranged as explained above is now explained. From the state shown in FIG. 17, the piston rods 24 of the supporting cylinders 22 are extended to lower the mounting frame 26 (and therefore the sand hopper 28, the upright members 66, and the flask 4), while the cylinders 56 are being actuated to lower the filling frame 52. Further, four central squeeze feet 46 (as in FIG. 19) are extended to their lower positions. Thus, as in FIG. 20, the flask 4 is placed on the pattern plate 72*a*; the filling frame 52 is placed on the flask 4; and the sand hopper 28 that includes the squeeze feet 46 is located just above the filing frame 52. The pattern plate 72*a*, the flask 4, the filling frame 52, and the sand hopper 28 that includes the squeeze feet 46 define a mold space. The air supply pipes 86 in FIG. 20 are in fluid communication with the mold space.

Figure 20:
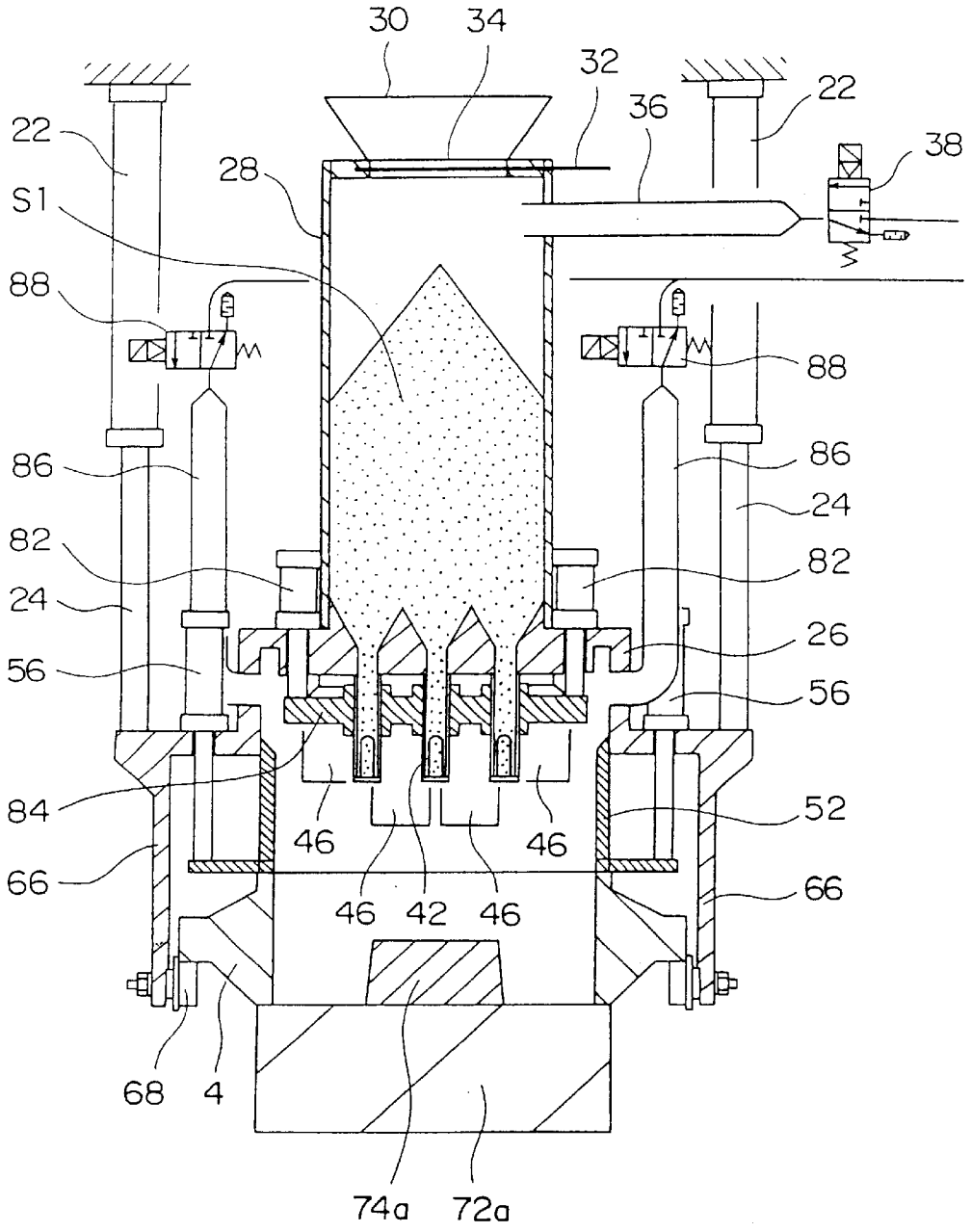
FIG. 20 shows the molding machine of FIG. 17 wherein a mold space has just been defined.
Figure 21:
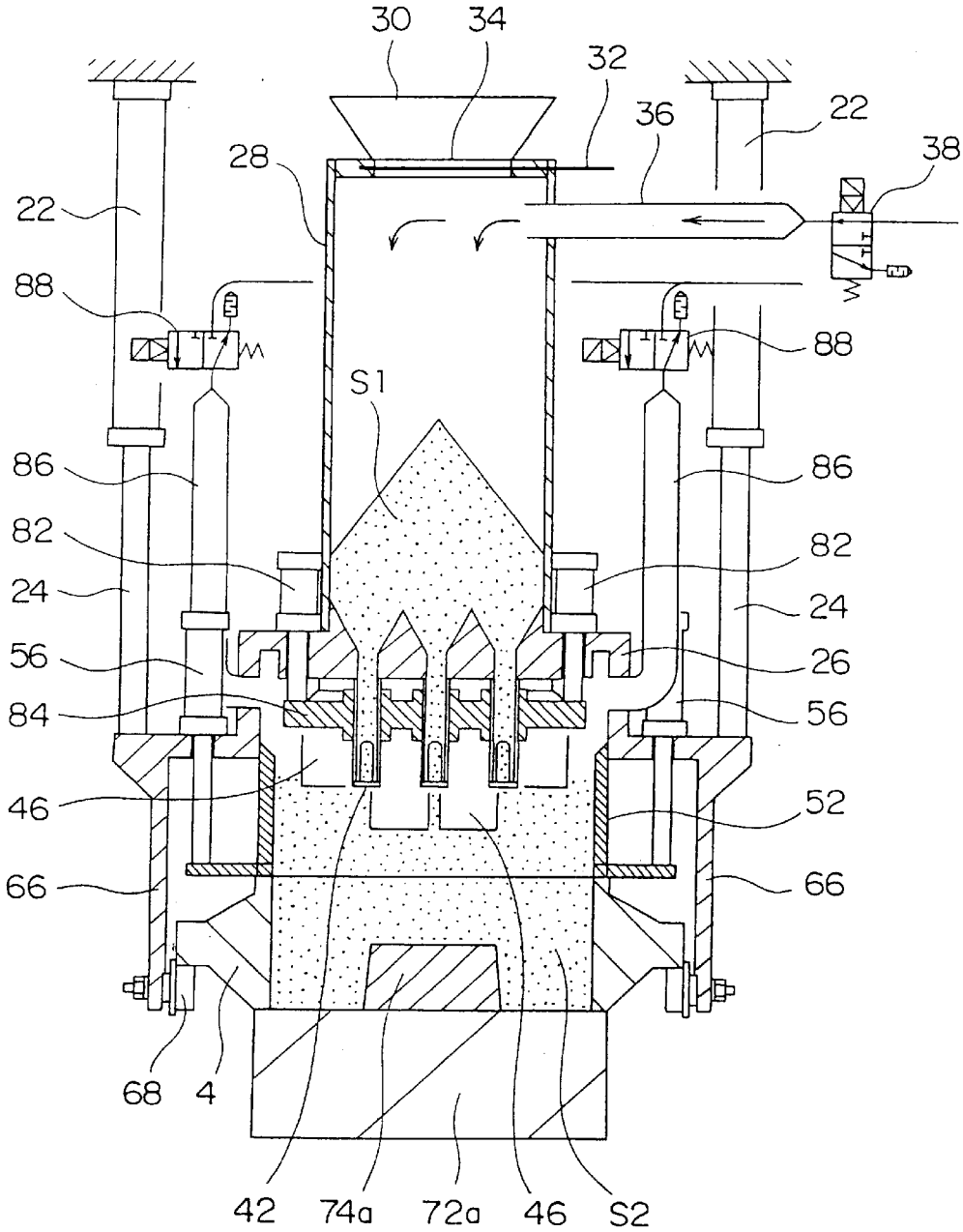
FIG. 21 shows the mold space of FIG. 20 into which molding sand has been introduced.
Figure 22:
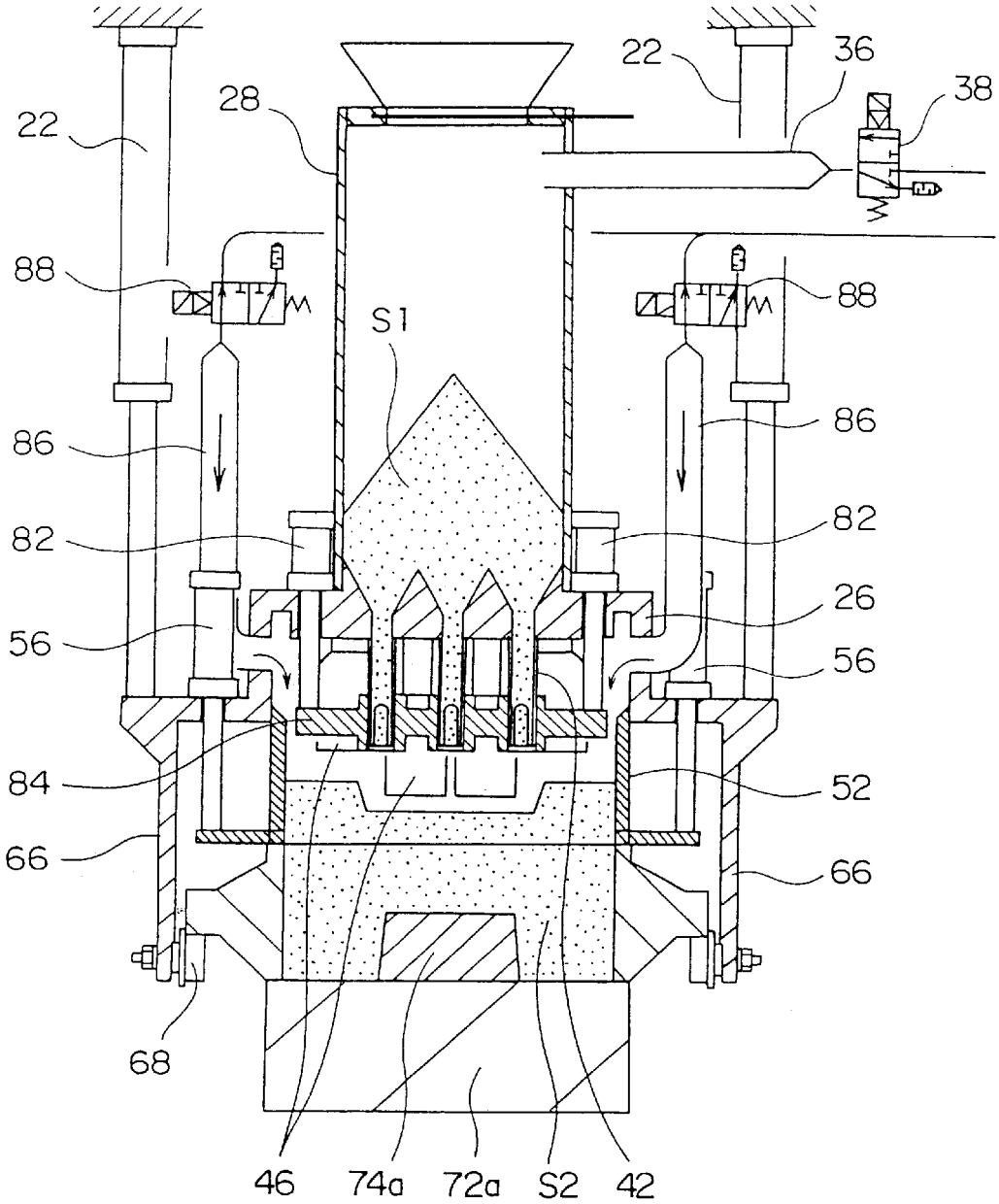
FIG. 22 is an explanatory drawing to show the introduction of compressed air into the molding sand in the mold space of FIG. 21 to pre-compact the molding sand.

From the state shown in FIG. 20 the valve 38 is opened to introduce compressed air into the sand hopper 38, as shown by arrows in FIG. 21. Thus the molding sand S1 in the sand hopper 28 is introduced into the mold space by the blowing introduction. The air introduced during this blowing introduction is discharged from the vent holes (not shown) formed in the pattern plate 72 and from the air supply pipes 86. As is clear from FIG. 21, the molding sand S2 introduced into the mold space is concave at the top central part and is also concave at the bottom central part (because the part is occupied by the pattern). From this state, as shown in FIG. 22, the cylinders 82, 82 are actuated to lower the bottom cover 84 to close the openings 43 of the nozzles, and the compressed air is introduced into the mold space through the air supply pipes 86 as shown by the arrows to pre-compact the molding sand S2.

The cylinders 56, 56 of the filling frame are then retracted, while the piston rods 24 of the cylinders 22 are being extended under a pressure higher than the control pressure of the squeeze feet 46 to further lower the sand hopper 28 until the squeeze feet 46 reach their upper locations, to further compact the molding sand S2 in the mold space. Thus, as shown in FIG. 23, the upper surface of the molding sand S2 is leveled by the bottoms of the squeeze feet 46, and the molding sand is uniformly compacted regardless of the different thicknesses (heights) it may have in the flask 4 and the filling frame 52.

Figure 23:
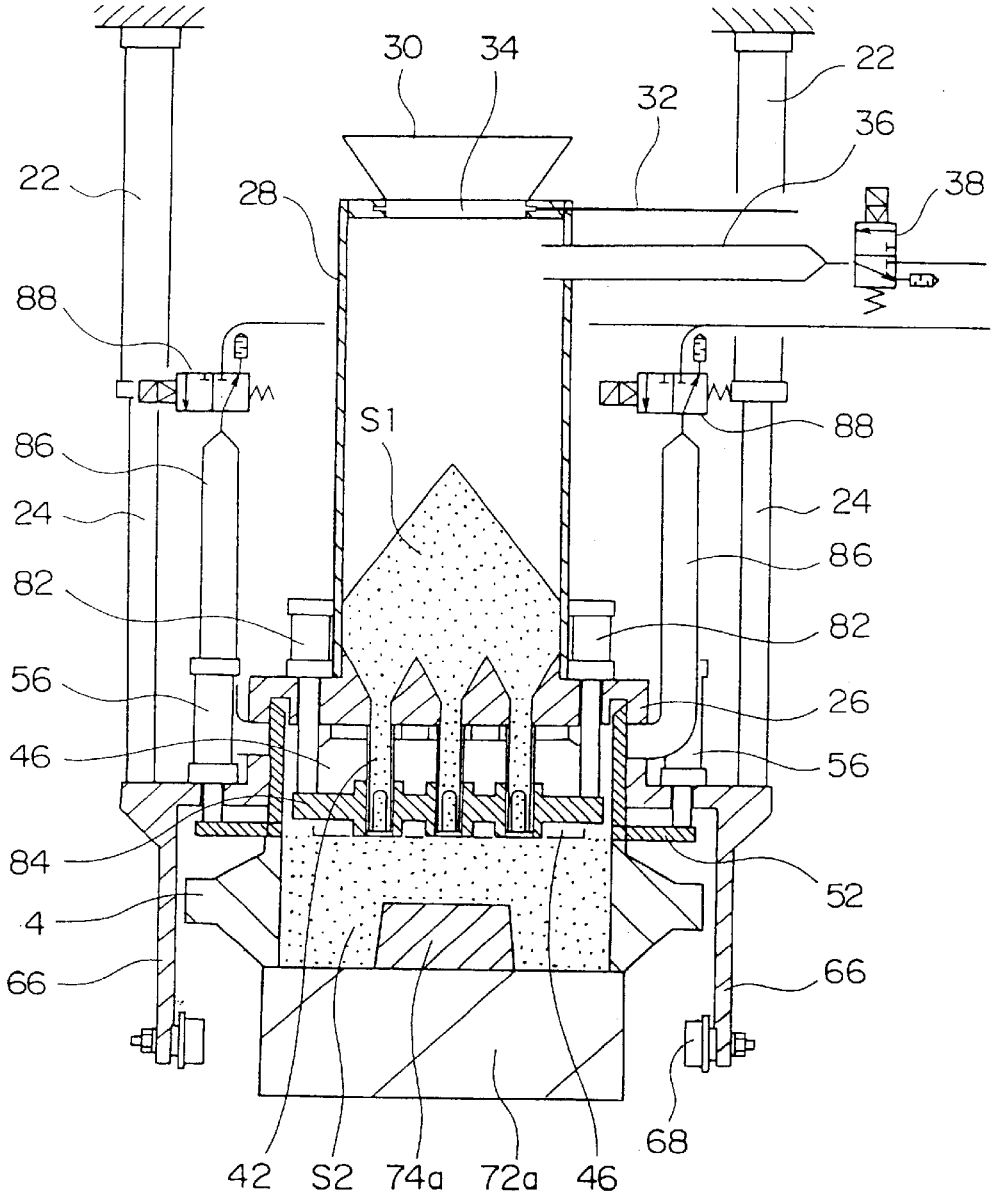
FIG. 23 shows the molding sand being further compacted from the state shown in FIG. 22 by the molding-sand introducing and compacting device of the molding machine.

From the state shown in FIG. 23 the piston rods 24 of the supporting cylinders 22 are retracted to raise the sand hopper 28. Thus the flask 4, holding a produced sand mold, is brought up to the level of the pass line 2 by the conveyor 68.

The sand mold held in the flask is transferred along the pass line away from the molding-sand introducing and compacting station of the molding machine, and a new flask 4 is transferred into the station. Further, molding sand S1 is introduced in the sand hopper 28 through its upper opening 34, and the slide gate 32 is then closed. The cylinders 82 are then actuated to raise the bottom cover 84, so that the molding machine is restored to its original state (the state shown in FIG. 17).

Although some embodiments of the present invention have been explained above, these are exemplary only, and do not limit the present invention. The invention is to be defined by the claims.

What is claimed is:

1. A molding machine for producing a sand mold by compacting molding sand in a mold space defined by a pattern plate having a pattern and placed at a predetermined position, a flask placed on the pattern plate for surrounding the pattern, and a filling frame placed on the flask, comprising:

a plurality of fixedly mounted upright cylinders spaced apart from each other;

a mounting frame secured to distal ends of piston rods of the upright cylinders such that the mounting frame is supported above the mold space and moved vertically by the cylinders;

a sand hopper, for holding the molding sand therein, secured to the mounting frame such that the sand hopper is advanced into the filling frame when lowered by the cylinders, the sand hopper having at a lower portion thereof a plurality of separated nozzles for discharging molding sand into the mold space; and a plurality of squeeze feet mounted on the lower portion of the sand hopper at locations adjacent to a side of each of the separated nozzles for substantially closing, together with the lower part of the sand hopper, an upper part of the filling frame and for compacting, together with the lower part of the sand hopper, the molding sand in the mold space when the sand hopper is lowered and advanced into the filling frame by the cylinders after the molding sand is introduced into the mold space.

2. The molding machine of claim 1, wherein each squeeze foot is a cylinder, the degree that each cylinder can be extended being adjustable such that the squeeze foot is extended to a selected position below a bottom of the sand hopper when the upper part of the mold space is closed by lowering the sand hopper.

3. The molding machine of claim 1, wherein the sand hopper includes means for carrying out aeration introduction of the molding sand.

4. The molding machine of claim 3, further comprising a filling frame that has a plurality of vent holes for controlling discharge of airflow when the aeration introduction is carried out.

5. The molding machine of claim 1, further comprising a base for supporting the pattern plate and the flask, wherein the cylinders are upwardly-facing and mounted on the base.

6. The molding machine of claim 1, wherein the mounting frame includes means for vertically carrying and placing the flask on the pattern plate placed at the predetermined position.

7. The molding machine of claim 6, wherein the mounting frame includes a conveyor means that horizontally transfers the flask at a level above the predetermined position of the pattern plate.

8. The molding machine of claim 1, further comprising a filling frame disposed around the lower part the sand hopper, wherein one of the mounting frame and the sand hopper further includes cylinders for vertically carrying the filling frame relative to the mounting frame to place the filling frame on the flask.

9. The molding machine of claim 1, further comprising a carrier for carrying the pattern plate and a transfer device for transferring the carrier between the predetermined position and a position different from the predetermined position, but located in a plane in which the predetermined position lies.

10. The molding machine of claim 9, wherein the transfer device includes the carrier for carrying the pattern plate, another carrier for carrying another pattern plate, and means for rotating both carriers in the plane to locate the carriers at the predetermined location.

11. The molding machine of claim 1, comprising a table for supporting the pattern plate, wherein the pattern plate includes a leveling frame on which the flask is placed for defining the mold space, the leveling frame being mounted on the table for surrounding an outer periphery of the pattern plate and for vertical movement.

12. A method for producing a sand mold held in a flask by compacting molding sand in a mold space, comprising the steps of:

a) placing at a predetermined position a pattern plate having a pattern;

b) placing a flask on the pattern plate;

c) placing a filling frame on the flask to define a mold space;

d) causing a molding-sand introducing and compacting device to approach the filling frame, the molding-sand introducing and compacting device including a sand hopper supported by a plurality of upright cylinders such that the sand hopper moves vertically, the sand hopper having a plurality of separated sand-discharging nozzles at a lower portion thereof, the molding-sand introducing and compacting device including a plurality of squeeze feet mounted on the lower portion of the sand hopper at locations adjacent to a side of each nozzle, thereby substantially closing an upper part of the mold space by means of the lower portion of the sand hopper and a plurality of the squeeze feet;

e) discharging molding sand from the nozzles to introduce the molding sand into the mold space;

f) lowering and advancing the sand hopper and a plurality of the squeeze feet into the filling frame by means of the cylinders, thereby compacting the molding sand in the mold space by means of the lower portion of the hopper and the squeeze feet;

g) raising the molding-sand introducing and compacting device, the filling frame, and the flask such that the flask holding a sand mold therein is separated from the pattern plate and the filling frame; and h) transferring the flask holding the sand mold therein to a predetermined position.

13. The method of claim 12, wherein the step of discharging the molding sand from the nozzles to introduce the molding sand into the mold space includes at least one of aerating the molding sand in the sand hopper adjacent to and upstream of the nozzles to fluidize the molding sand there and introducing compressed air from above into the sand hopper.

14. The method of claim 13, wherein the step of discharging the molding sand from the nozzles to introduce the molding sand into the mold space includes aerating the molding sand in the sand hopper adjacent to and upstream of the nozzles to fluidize the molding sand there, wherein a filling frame having a plurality of vent holes are used as the filling frame, and wherein controlling discharging air that comes from the aerating is performed through the vent holes.

15. The method of claim 12, further comprising, in the step of compacting the molding sand in the mold space, squeezing out air contained in the sand mold by maintaining a compacting force for a predetermined period of time when the compacting force reaches a predetermined value.

16. The method of claim 12, further comprising disposing a leveling frame around an outer periphery of the pattern plate such that a top of the leveling frame is positioned above a top surface of the outer periphery of the pattern plate, the leveling frame being vertically movable, and placing the flask on the top of the leveling frame, the method comprising defining the mold space by the pattern plate, the leveling frame, the flask, the filling frame, and the molding-sand introducing and compacting device placed near the filling frame and secondarily compacting the molding sand after the compaction of the molding sand in the mold space by step f) by lowering the leveling frame until the top of the leveling frame comes substantially to the level of the top surface of the outer periphery of the pattern plate and lowering the flask, the filling frame, and the sand hopper.

17. The method of claim 12, further comprising the steps of:

causing each of a plurality of the squeeze feet to be extended to a selected position that is below the lower portion of the sand hopper when the molding-sand introducing and compacting device approaches the filling frame to close the mold space; and operating the cylinders with a pressure higher than a control pressure for the squeeze feet, to compact the molding sand so that an upper surface of the molding sand after the compaction is made flat, when the molding sand is compacted by lowering the sand hopper by means of the cylinders.

* * * * *

UNITED STATES PATENT AND TRADEMARK OFFICE

CERTIFICATE OF CORRECTION

PATENT NO. : 6,662,855 B1
DATED : December 16, 2003
INVENTOR(S) : Kimikazu Kaneto et al.

It is certified that error appears in the above-identified patent and that said Letters Patent is hereby corrected as shown below:

Title page,
Item [54], Title, delete in its entirety and insert therefor
-- APPARATUS AND METHOD FOR PRODUCING SAND MOLD --.

Signed and Sealed this

Seventh Day of September, 2004

JON W. DUDAS
*Director of the United States Patent and Trademark Office*